US010487605B2

(12) United States Patent
Nelson et al.

(10) Patent No.: US 10,487,605 B2
(45) Date of Patent: Nov. 26, 2019

(54) METHOD OF WELLBORE ISOLATION WITH CUTTING AND PULLING A STRING IN A SINGLE TRIP

(71) Applicant: BAKER HUGHES, A GE COMPANY, LLC, Houston, TX (US)

(72) Inventors: Jonathan F. Nelson, Cypress, TX (US); Jason L. Cullum, League City, TX (US); Philip M. Gregurek, Pearland, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 348 days.

(21) Appl. No.: 15/419,435

(22) Filed: Jan. 30, 2017

(65) Prior Publication Data

US 2018/0216432 A1 Aug. 2, 2018

(51) Int. Cl.
*E21B 29/00* (2006.01)
*E21B 33/12* (2006.01)

(52) U.S. Cl.
CPC ..... *E21B 29/002* (2013.01); *E21B 29/005* (2013.01); *E21B 33/12* (2013.01)

(58) Field of Classification Search
CPC ..... E21B 29/002; E21B 29/005; E21B 33/12
See application file for complete search history.

(56) References Cited

U.S. PATENT DOCUMENTS

| | | | | |
|---|---|---|---|---|
| 6,464,008 | B1 | 10/2002 | Roddy et al. | |
| 6,745,834 | B2 | 6/2004 | Davis et al. | |
| 8,869,896 | B2 | 10/2014 | Crow et al. | |
| 8,881,818 | B2 | 11/2014 | Crow et al. | |
| 8,955,597 | B2 | 2/2015 | Connell et al. | |
| 2014/0251616 | A1* | 9/2014 | O'Rourke | E21B 29/005 166/298 |
| 2015/0275605 | A1* | 10/2015 | Bennett | E21B 29/002 166/298 |
| 2018/0195359 | A1* | 7/2018 | Pray | E21B 31/16 |

* cited by examiner

*Primary Examiner* — Brad Harcourt
(74) *Attorney, Agent, or Firm* — Shawn Hunter

(57) ABSTRACT

A one trip bottom hole assembly allows setting and testing a plug and release from the plug. Cement can be pumped onto the plug, after the BHA is raised, to an extent to meet local regulatory requirements. The cutter spear combination can be activated with pressure built on a second dropped ball larger than the first ball to release the blades for extension with fluid circulation. The circulation path through the spear is opened using pipe manipulation during the spear setting sequence. The cuttings from severing the tubular fall onto the cement. The spear is set with string manipulation as the drill string rotates the blades while maintaining the string under tension. The spear can be released and repositioned for the top of the string to facilitate removal and disassembly at the surface. All the above described operations are accomplished with a single trip into the hole.

28 Claims, 1 Drawing Sheet

METHOD OF WELLBORE ISOLATION WITH CUTTING AND PULLING A STRING IN A SINGLE TRIP

FIELD OF THE INVENTION

The field of the invention is well abandonment and more particularly a one trip method for plugging the well with a plug and delivering cement to seal the well above the plug followed by supporting and cutting the tubular for removal above the cut.

BACKGROUND OF THE INVENTION

One way a well is plugged and abandoned is to set a bridge plug and pump a cement plug above the plug. The string is cut and removed above the cut. This has been done in multiple trips in the hole in the past. Discrete segments of the above steps have been done in a single trip such as setting a bridge plug and cementing above it or cutting and pulling a string above the cut. Relevant to such subsets of operations done in a single trip are U.S. Pat. Nos. 6,464,008; 6,745,834 and 8,869,896. One holdback in the past to accomplishing all these tasks in a single trip has been an inability to convey pressure through a spear cutter combination that accommodates relative rotation between the spear and the cutter. Another issue is the ability to actuate the tools in the desired sequence. Hydraulic actuation that involves dropped balls also precluded rotation of cutting blades with a downhole motor.

The present invention use a modular approach to sequential operation of the components needed to plug the hole with a plug and then deliver a cement plug to meet local plugging regulations followed with cutting and removal of the string above the cut. The bottom hole assembly that is envisioned for a one trip operation starts with a plug with an open passage for circulation for running in. Once the plug is properly located a ball is landed on a seat to set and release from the packer. Cement is pumped through a spear cutter combination onto the plug that has its passage blocked with the first dropped ball. The set plug can also be pressure tested before or after cement delivery depending on local regulations. Setting the plug releases the setting tool from the plug so the bottom hole assembly (BHA) can be repositioned for delivery of cement to create the barrier on the plug. The spear can be set with axial and rotational movements of the string supporting the BHA. The cutter blades are enabled to extend by seating a larger second ball and pressuring up. After that a circulation path opens in the cutter and flow extends the blades. The string rotates the cutter relative to the spear while tension is pulled on the string as it rotates. After cutting through the tubular, the flow is discontinued to let the blades retract. The spear can be released and repositioned to the top of the string to make string disassembly easier than if the spear were to be left at the bottom of the string just above the cut. The spear drains as it is removed to avoid pulling out the drill string wet. These and other aspects of the present invention will be more readily apparent to those skilled in the art from a review of the description of the preferred embodiment and the associated drawings while recognizing that the full scope of the invention is to be found in the appended claims.

SUMMARY OF THE INVENTION

A one trip bottom hole assembly allows setting and testing a plug and release from the plug. Cement can be pumped onto the plug, after the BHA is raised, to an extent to meet local regulatory requirements. The cutter spear combination can be activated with pressure built on a second dropped ball larger than the first ball to release the blades for extension with fluid circulation. The circulation path through the spear is opened using pipe manipulation during the spear setting sequence. The cuttings from severing the tubular fall onto the cement. The spear is set with string manipulation as the drill string rotates the blades while maintaining the string under tension. The spear can be released and repositioned for the top of the string to facilitate removal and disassembly at the surface. All the above described operations are accomplished with a single trip into the hole.

DETAILED DESCRIPTION OF THE PREFERRED EMBODIMENT

Figures 1, 2, 3, 4, 5, 6:
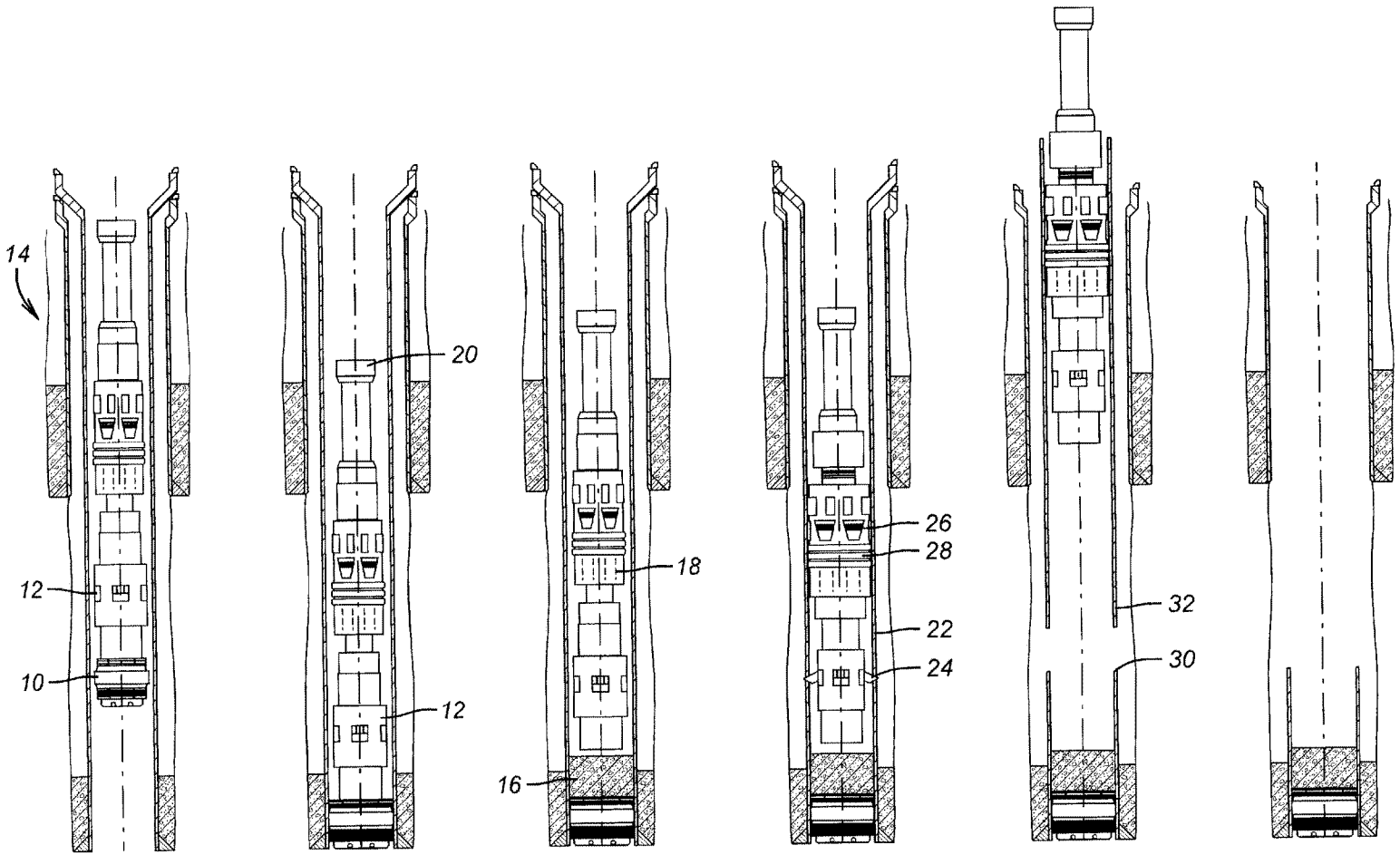
FIG. 1 illustrates running in the BHA.
FIG. 2 is the view of FIG. 1 with the plug set and the BHA released from the plug.
FIG. 3 is the view of FIG. 2 with the cement delivered to form a barrier on the plug.
FIG. 4 is the view of FIG. 3 showing the cutter blades extended and the spear engaged to the string for tension as the blades cut the string.
FIG. 5 is the view of FIG. 4 with the spear lifting the string from the hole.
FIG. 6 is the view of FIG. 5 with the string removed from the hole.

The BHA is shown being run in in FIG. 1. At the bottom is plug 10 that has a setting tool with passage through it with a ball seat, neither of which are shown. The setting tool passage allows fluid to enter when running in when the plug is unset and closes the plug 10 passage when the ball lands so the plug can be set with surface applied pressure. The setting tool releases from the plug 10 after the plug is set with overpull or rotation of the BHA. The plug 10 can then be pressure tested and can serve as a sealant 16 support. In FIG. 2 the plug 10 is still shown against the casing cutter 12 but the two are still shown abutting with the plug 10 set and self-supporting in FIG. 2. The casing cutter 12 has a flow passage therethrough and is constructed to hold the pressure that needs to be built up to set the plug 10. Essentially a first and smaller ball lands on a setting tool seat around a passage so that surface applied pressure can set the plug. In FIG. 2 the plug 10 is released from the BHA 14.

At this point in FIG. 2 the plug with a ball on a seat in a passage through the plug can serve as a support for cement or another sealant 16 that is added through the BHA 14. The plug can be tested to make sure it holds pressure with a pressure test or vacuum test preferably before the sealer material 16 is delivered and set up. The cement 16 is delivered through a drill string 20 that supports the BHA 14. The spear 22 also has a through passage that communicates through the casing cutter 18. The BHA 14 is picked up and a predetermined amount of material 16 is delivered from the surface to provide the height of material 16 needed to meet local regulatory requirements. Excess cement that may be in the string 20 or BHA 14 can be circulated out with water or well fluid.

When the cement 16 sets the casing or tubing 2 can be cut. The blades 4 that up to this time had been locked retracted need to be mechanically released. A second ball is landed on a sleeve that locks the blades 24 retracted. When that locking sleeve is shifted the blades 24 are able to rotate into cutting position with flow that is enabled with the shifting of the blade locking sleeve. Flow through the mandrel of the casing cutter 12 can continue out and can return uphole through a screened return passage that that opens when the spear 18 is set with string manipulation. Right hand rotation of the spear 18 with upward string motion allows the slips 26 and seal 28 to extend and hold the set position. The j-slot mechanism (not shown) un-locks an inner mandrel (not shown) from the outer body to allow said inner mandrel to rotate freely through the engaged outer body (containing slip assembly 26), therefore allowing drill string 20 rotation to be transferred to the cutter 12 below the spear while the outer body remains stationary. The spear 18 is set by picking up and turning to the right, and released by setting down and turning to the right. Setting the spear 18 opens a screened return flow path uphole through the spear 18 so that flow can move through the tubular cutter 12 to keep the blades 24 extended as the string 20 is rotated putting tension on tubular 22 above the cut 30.

FIG. 5 shows the cut already made and the BHA 14 raised up with the string 22. To make surface disassembly simpler the spear 18 can be released after the cut is finished and flow cut off to let the blades 24 retract. The string 22 can be re-grabbed near its upper end to make disassembly of the string sections simpler at the surface location. The string 22 can still be disassembled at a surface location with the support at the lower end 32 as shown. FIG. 6 shows the string 22 out of the hole with all the operations described above being performed in a single trip.

While the bulk of the devices described above are known, what enables the method to occur in a single trip is the idea of making all these events happen in a single trip in the first place followed by adaptation of some of the components to convey pressure as well as devices that allow one component to be actuated without impairing the ability to separately actuate another component. The plug is set with a smaller ball than the ball that unlocks the blades to rotate out with flow. The sleeve that holds the blades retracted is subsequently actuated by a larger ball that opens a lateral passage to allow flow through the casing cutter to extend its blades. The BHA is open to circulation for running in. Setting the plug and releasing the BHA closes the passage through the plug so a pressure test can be run. The passage through the BHA is reopened when the setting tool for the plug releases from the plug. The casing cutter and spear are designed to contain the setting pressure for the plug. The dropping of the second and larger ball into the casing cutter allows a second pressure buildup to move a sleeve that results in not only freeing the blades to respond to flow and extend but also allowing flow to be initiated as a mandrel passage is opened when the blades are freed to respond to flow to rotate into cutting position. The spear is set with a pickup and rotation force to the right. The release involves setting down and rotating to the right again. The spear is set and tension is applied before the rotation of the drill string starts the blades rotating. The drill string turns freely within the spear and the pickup force while turning allows the casing cutter to deliver a tensile force to the string being cut. The cuttings fall on the cement plug and the circulation flow passes through a passage that is screened in the spear that opens when the spear is set to extend the slips and sealing element to the surrounding tubular. As a result the process of plug setting, cement delivery, grabbing the casing with a spear and rotating a cutter through the spear with the drill string all occur in the same trip. The string is cut in tension and either the casing is brought out with the spear gripping near the cut, or preferably the spear is repositioned to the top of the string to facilitate separation of the joints in the casing at the surface.

The above description is illustrative of the preferred embodiment and many modifications may be made by those skilled in the art without departing from the invention whose scope is to be determined from the literal and equivalent scope of the claims below:

We claim:

1. A one trip method of plugging a borehole and cutting and removing a tubular string comprising:

actuating a plug on a bottom hole assembly (BHA) against a surrounding tubular string; releasing the BHA from the actuated plug;

securing the tubular string with a spear mounted to the BHA;

making a cut in the tubular string with a cutter on the BHA, the cutter being selectively rotationally locked to the spear;

removing a portion of said tubular string above the cut with said spear;

performing the above with a single trip of said BHA into the borehole.

2. The method of claim 1, comprising:

delivering a sealing material on said plug.

3. The method of claim 2, comprising:

pressurizing said spear and cutter when setting said plug.

4. The method of claim 2, comprising:

delivering a first object to said plug for setting said plug with pressure in said BHA.

5. The method of claim 4, comprising:

delivering a second object larger than said first object to said cutter after said plug is actuated to release said cutter to rotate relatively to said spear.

6. The method of claim 2, comprising:

moving said BHA axially or rotationally to release from said actuated plug.

7. The method of claim 2, comprising:

releasing said cutter to rotate relatively to said spear.

8. The method of claim 2, comprising:

releasing blades on said cutter to be flow responsive to extend toward the tubular string.

9. The method of claim 8, comprising:

delivering an object to said cutter to perform said releasing with applied pressure.

10. The method of claim 2, comprising:

setting said spear with longitudinal and rotational BHA movement.

11. The method of claim 10, comprising:

opening a screened return passage around a sealing element in said spear.

12. The method of claim 11, comprising:

circulating through said screened return passage as said cutter cuts the tubular string.

13. The method of claim 2, comprising:

allowing cuttings formed by said cutter to collect on said sealing material.

14. The method of claim 2, comprising:

releasing and repositioning said spear on the tubular string for a grip adjacent a surface end of said tubular string for said removal of the tubular string.

15. The method of claim 2, comprising:

putting said tubular string in tension with said spear while creating said cut.

16. The method of claim 15, comprising:

rotating said BHA with a drill string to cut the tubular string.

17. The method of claim 2, comprising:

using cement as said sealing material.

18. A method of plugging a borehole and cutting and removing a tubular string, comprising:

actuating a plug on a bottom hole assembly (BHA) against a surrounding tubular string;

releasing the BHA from the actuated plug;

securing the tubular string with a spear mounted to the BHA;

making a cut in the tubular string with a cutter on the BHA, the cutter being selectively locked to the spear;

removing a portion of said tubular string above the cut with said spear;

performing the above optionally with a single trip of said BHA into the borehole.

19. A borehole plugging and tubular cutting and removal apparatus, comprising:

a plug;

a tubular cutter selectively connected to said plug and further comprising a passage therethrough to communicate pressure to set said plug with an actuator, said actuator selectively releasable from said plug;

a spear to selectively support a tubular string above a cut made by said tubular cutter, said spear comprising a passage communicating with said tubular cutter for setting said plug; and said tubular cutter is selectively rotationally locked to said spear.

20. The apparatus of claim 19, wherein:

said spear pulls tension on the tubular string when said tubular cutter makes said cut.

21. The apparatus of claim 19, wherein:

said plug is actuated with an object on a seat and applied pressure to said first object.

22. The apparatus of claim 19, wherein:

said rotational lock is defeated with pressure applied to an object in said tubular cutter.

23. The apparatus of claim 22, wherein:

said tubular cutter comprises blades that radially extend with flow through said tubular cutter.

24. The apparatus of claim 23, wherein:

said blades are enabled to pivot to extend radially as a result of said pressure applied to said object in said tubular cutter.

25. The apparatus of claim 24, wherein:

said spear is set by manipulation of a supporting tubular string to extend at least one slip and at least one sealing element to the tubular string cut by said tubular cutter.

26. The apparatus of claim 25, wherein:

a screened return passage around said at least one seal opens when said spear is set.

27. The apparatus of claim 25, wherein:

said supporting tubular string rotates said tubular cutter and delivers a sealing material onto said plug when set through said spear and said tubular cutter.

28. The apparatus of claim 27, wherein:

said sealing material comprises cement.

* * * * *